US009874096B2

(12) United States Patent
Lucieer et al.

(10) Patent No.: US 9,874,096 B2
(45) Date of Patent: Jan. 23, 2018

(54) SUBSEA CONTAINER TRANSPORT SYSTEM FOR DEEP-SEA MINING

(71) Applicant: IHC HOLLAND IE B.V., Sliedrecht (NL)

(72) Inventors: Pieter Abraham Lucieer, Barendrecht (NL); Harmen Derk Stoffers, Breda (NL); Laurens Jan De Jonge, Delft (NL)

(73) Assignee: IHC Holland IE B.V., Sliedrecht (NL)

( * ) Notice: Subject to any disclaimer, the term of this patent is extended or adjusted under 35 U.S.C. 154(b) by 0 days.

(21) Appl. No.: 14/909,383

(22) PCT Filed: Jul. 31, 2014

(86) PCT No.: PCT/NL2014/050531
§ 371 (c)(1),
(2) Date: Feb. 1, 2016

(87) PCT Pub. No.: WO2015/016712
PCT Pub. Date: Feb. 5, 2015

(65) Prior Publication Data

US 2016/0176664 A1 Jun. 23, 2016

(30) Foreign Application Priority Data

Aug. 1, 2013 (NL) ..... 2011251

(51) Int. Cl.
*E21C 50/00* (2006.01)
*E02F 3/08* (2006.01)
(Continued)

(52) U.S. Cl.
CPC ..... *E21C 50/00* (2013.01); *B63B 27/02* (2013.01); *E02F 3/081* (2013.01); *E02F 7/005* (2013.01); *E21C 5/00* (2013.01)

(58) Field of Classification Search
CPC .. E21C 50/00; E02F 7/005; E02F 3/08; E02F 3/081; E02F 3/082; E02F 3/46; E02F 3/47; E02F 3/48; E02F 3/52; E02F 3/54
See application file for complete search history.

(56) References Cited

U.S. PATENT DOCUMENTS 1,540,276 A * 6/1925 Nichols ..... E02F 3/145 198/707
3,675,348 A * 7/1972 Dane, Jr. ..... E02F 3/081 172/26.5

(Continued)

FOREIGN PATENT DOCUMENTS

WO 2013/030605 A2 3/2013

OTHER PUBLICATIONS

International Search Report, dated Mar. 31, 2015, from corresponding PCT Application.

*Primary Examiner* — Andrew J Triggs
(74) *Attorney, Agent, or Firm* — NLO N.V.; Catherine A. Shultz

(57) ABSTRACT

A mining system includes:
- a vessel for processing mined ore,
- an upper platform coupled with the vessel,
- a lower platform supported by the ocean floor,
- a number of transport cables which extend between the upper and lower platform, and
- a container for containing ore which container is fixedly coupled to a container transporting cable such that the container moves vertically with the container transporting cable to transport the container in a container trajectory extending between the upper and lower platform.

13 Claims, 3 Drawing Sheets

(51) Int. Cl.

| | |
|---|---|
| ***E02F 7/00*** | (2006.01) |
| ***E21B 19/08*** | (2006.01) |
| ***B63B 27/00*** | (2006.01) |

(56) References Cited

U.S. PATENT DOCUMENTS

| | | | | | |
|---|---|---|---|---|---|
| 3,955,294 | A * | 5/1976 | Morgenstein | E02F 3/081 | 198/711 |
| 3,968,579 | A * | 7/1976 | Rossfelder | E02F 3/081 | 114/294 |
| 4,010,560 | A * | 3/1977 | Diggs | E02F 3/082 | 299/9 |
| 4,336,662 | A | 6/1982 | Baird | | |
| 4,685,742 | A | 8/1987 | Moreau | | |
| 4,937,956 | A * | 7/1990 | Malecha | E02F 3/081 | 198/509 |
| 5,199,767 | A | 4/1993 | Jimbo | | |
| 5,638,620 | A * | 6/1997 | Van Der Kooy | E02F 3/081 | 37/316 |
| 2016/0176664 | A1 * | 6/2016 | Lucieer | E21O 5/00 | 414/142.8 |

* cited by examiner

SUBSEA CONTAINER TRANSPORT SYSTEM FOR DEEP-SEA MINING

BACKGROUND

The present invention relates to a mining system comprising;

- a vessel for processing mined ore,
- an upper platform coupled with the vessel,
- a lower platform supported by the ocean floor,
- a number of transport cables which extend between the upper and lower platform,
- a container for containing ore and transporting it between the upper and lower platform.

In general, sea mining systems consist of a mining vessel with hoppers and bins launched from the mining vessel. These bins transport the ore from the sea bed to the mining vessel. A subsea frame receives the bins on the seafloor. The bins that transport the ore to the surface are suspended from the vessel using steel wires, and are usually closed using a lid.

Such a mining system is known from U.S. Pat. No. 4,010,560 wherein is disclosed a deep sea mining apparatus and method for mining mineral nodules from the ocean floor, comprises a surface ship and a plurality of nodule harvesting or mining machines supported from the surface ship and resting on the ocean floor for movement along the ocean floor and including nodule gathering devices to gather the mineral nodules as the machine passes over the ocean floor. The nodule harvesting machines include separable, nodule-containing crates which, when full, are lifted to the surface where they are recovered by a surface ship. The crates are emptied of their contents and subsequently returned to the machines on the ocean floor to be refilled. A pair of cables are connected with and controlled from the cranes, respectively, and the cables are connected with the mining machine for supporting and controlling the mining machine. The pair of cables are connected with the machine at opposite sides thereof near the rear portion of the machine for lowering and guiding the empty crates to the machine, and the other cables are connected with the main portion of the machine near the front thereof for supporting and controlling the machine M. The crates C each have a cable clamping device at the opposite sides thereof, respectively, for releasable engagement with the crate lowering and guiding cables, whereby the crates may be lowered and guided at a controlled rate of descent to the platform. Immediately thereafter, the timer means also energizes a release mechanism associated with the cable clamping devices to release the crate from the cables, and the power means connected with the sprockets, is then operated in a first direction to move the endless belts or chains or the like and to move the filled crate to the rear of the machine and onto the floor of the body of water.

Prior art mining systems do have drawbacks in that a load suspended in wires is hard to control while moving through the splash zone. Furthermore the lowering speed is limited by the resistance of the bin while moving through the water column. In addition, the clamp/release system, which couples the load to the wire/releases the load from the wire, is fault sensitive which is crucial in deep sea operations. Also, the required amount of wires to control bin movement and launching/hoisting of the subsea platform is cumbersome. In addition, when suspended on one wire, or on two wires while coupled at one point of each of said wires, a container is relatively free to rotate. This may result in a non-defined position of the bin while landing on the subsea frame or recovering on the vessel, which e.g. may cause the lid to be on the wrong side

SUMMARY OF THE INVENTION

The invention aims to reduce the amount of wires in a mining system as described above.

Another object of the invention is to improve a known mining system in that a problem associated therewith is at least partly solved.

Yet another object of the invention is to provide an alternative mining system.

According to a first aspect of the invention this is realized with a mining system comprising;

- a vessel for processing mined ore,
- an upper platform coupled with the vessel,
- a lower platform supported by the ocean floor,
- a number of transport cables which extend between the upper and lower platform,
- a container for containing ore which container is fixedly coupled to a container transporting cable such that the container moves vertically with the container transporting cable to transport the container in a container trajectory extending between the upper and lower platform, wherein a container transporting cable section of the container transporting cable extends below the container, and in use pulls the container downwards for preventing pivoting of the container with respect to the container transporting cable, and wherein the container is coupled with a neighbouring container guiding cable via a coupling element for even further preventing pivoting of the container with respect to the container transporting cable during vertical transport of the container.

A vessel for processing mined ore has to be understood as a vessel capable of processing at least one step with mined ore. It is conceivable that the step is short term storage of the mined ore on the vessel.

The upper platform may by fixedly coupled with the vessel however it is conceivable that the platform is floating proximate the vessel.

A transport cable has to be understood as a cable suitable for transporting a container filled with ore from deep sea bottom to the surface. Such a container filled with ore may easily weigh 100 tons or more.

The mining system according to the invention provides the possibility of transporting ore while using a minimum amount of wires or cable length between the vessel and the seafloor. In addition, the invention enables a fixed coupling of the container with the cable and a more controllable vertical position of the container such that rotation of the container is avoided.

For controlling the vertical position of the container such that rotation of the container is avoided, a pull down wire is attached to the bins. This wire also ensures swift positioning of the bins when landing in the subsea frame. For controlling the vertical position of the container such that rotation of the container is avoided, a guiding system is provided, avoiding rotation of the bin. It will be clear that the "cable section of the container transporting cable extends below the container, and in use pulls the container downwards" is not limited to situation that the container moves downwards. Important is that the cable section exerts a downward directed force that assists in maintaining the upright position of the container.

In an embodiment of the invention, the container is fixedly coupled with just one container transporting cable extending in the entire container trajectory between the upper and lower platform. Just one has to be understood that one cable extends in the container trajectory which means there is a cable section above the container and a section below the container.

In an embodiment of the invention, the container is rotatably supported with respect to the one container transporting cable for rotating the container around a container rotation axis between a transport position and an ore release position wherein the container is emptied.

In an embodiment of the invention, the container rotation axis extends transverse with respect to the one container transporting cable.

In an embodiment of the invention, the one container transporting cable extends centrally with respect to the container.

In an embodiment of the invention, the one container transporting cable is tensioned in the entire container trajectory between the upper and lower platform during transport of the container. The tensioning assists in avoiding entanglement of adjacent cables.

In an embodiment of the invention, the container guiding cable extends alongside the entire container trajectory.

In an embodiment of the invention, the container guiding cable is tensioned alongside the entire container trajectory for preventing pivoting of the container.

In an embodiment of the invention, the coupling element is configured such that the container is coupled with the neighbouring container guiding cable in a sliding or rolling manner.

In an embodiment of the invention, the container transporting cable is coupled with the lower platform such that the container transporting cable turns and continues towards the upper platform.

In an embodiment of the invention, wherein the container transporting cable changes into the container guiding cable when turning at the lower platform.

In an embodiment of the invention, during transport of the container, the container guiding cable and the container transporting cable run in opposite direction.

According to a further aspect, the invention provides a device comprising one or more of the characterising features described in the description and/or shown in the attached drawings.

According to a further aspect, the invention provides a method comprising one or more of the characterising features described in the description and/or shown in the attached drawings.

The various aspects discussed in this patent can be combined in order to provide additional advantages.

DESCRIPTION OF THE DRAWINGS

The invention will be further elucidated referring to an preferred embodiment shown in the drawing wherein shown in.

In the figures schematic side view of a three embodiments of a mining system according to the invention is shown. The first embodiment in FIG. 1 will be described in detail. The differences of the other embodiments will be described with respect to the first embodiment.

Figure 1:
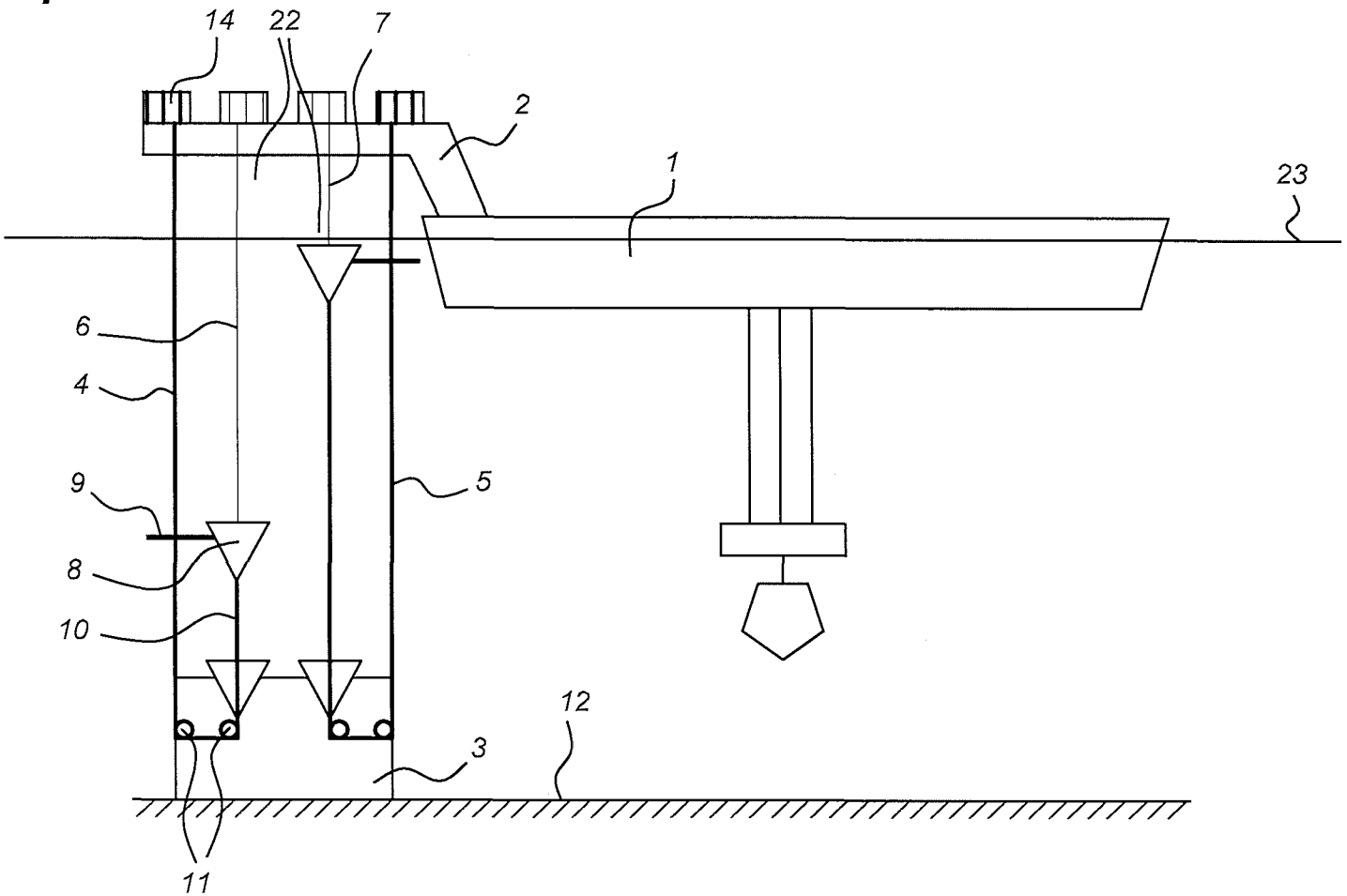
FIG. 1 a schematic side view of a first embodiment of a mining system according to the invention.

The mining system of FIG. 1 comprises a vessel 1 for processing mined ore. An upper platform 2 is fixedly coupled with the vessel 1. Here, the upper platform 2 is entirely above the water surface 23. A lower platform 3 is supported by the ocean floor 12. A number of transport cables 4, 5, 6, 7, extend between the upper 2 and lower platform 3. A container 8 for containing ore is fixedly coupled to a single container transporting cable 6 such that the container moves vertically with the container transporting cable 6 to transport the container in a container trajectory 22 extending between the upper 2 and lower platform 3. The single container transporting cable 6 extends in the entire container trajectory 22 between the upper and lower platform. The one container transporting cable 6 is tensioned in the entire container trajectory 22 between the upper and lower platform during transport of the container 8. The one container transporting cable 6 extends centrally with respect to the container 8. A container transporting cable section 10 of the container transporting cable 6 extends below the container 8 and, in use, pulls the container downwards for preventing pivoting of the container 8. From point of view of the transporting cable 6, the cable is split by the container 8 in an upper part in FIG. 1 denoted with reference number 6 and a lower part denoted with reference number 10. The container 8 is coupled with a neighbouring container guiding cable 4 via a coupling element 9 for preventing pivoting of the container 8 during vertical transport of the container 8. The container guiding cable 4 extends alongside the entire container trajectory 22. During transport of the container 8, the container guiding cable 4 and the container transporting cable 6 run in opposite direction.

The container 8 is rotatably supported with respect to the one container transporting cable 6 for rotating the container around a container rotation axis between a transport position and an ore release position. The container rotation axis extends perpendicular with respect to the transporting cable 6. The coupling element 9 is configured such that the container 8 is coupled with the neighbouring container guiding cable 4 in a sliding or rolling manner.

The container transporting cable 6 is coupled with the lower platform 3 such that the container transporting cable 6 turns and continues towards the upper platform 2 as a guiding cable 4. The container guiding cable 4 is coupled with the bottom of the container 8 and connected with the lower platform 3 via a return pulley 11, in this case two adjacent pulleys 11. The container transporting cable 6 is therefore coupled with the lower platform 3 via a return pulley 11, in this case two adjacent pulleys 11. The cables 6, 4 are coupled with the upper platform 2, each with a respective winch 14. The winches 14 serve also for lowering and lifting the lower platform 3 via the cables 4, 6, as desired.

Figure 2:
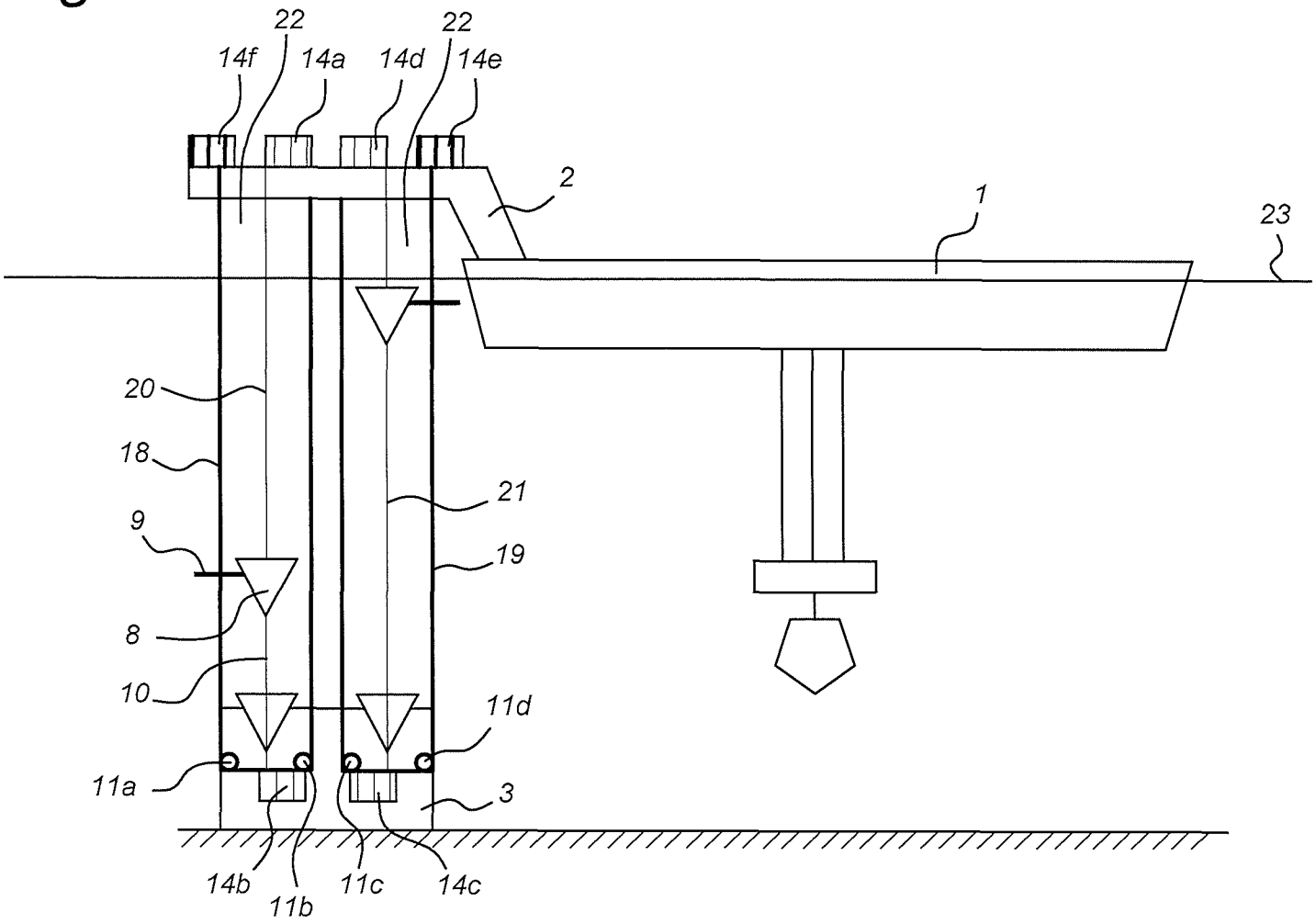
FIG. 2 a schematic side view of a second embodiment of a mining system according to the invention.

The embodiment of FIG. 2 differs with the first embodiment in that the lower platform 3 is provided with respective winches 14*b*, 14*c*. Respective transporting cables 20, 21 extend between respectively the winch 14*a* of the upper platform and winch 14*b*, and cable 21 between the winch 14*d* of the upper platform and winch 14*c*. The winches 14*a*, 14*d*, 14*e*, 14*f* serve for lowering and lifting the lower platform 3 via the cables 18, 19 in conjunction with the pulleys 11*a-d* as desired.

Figure 3:
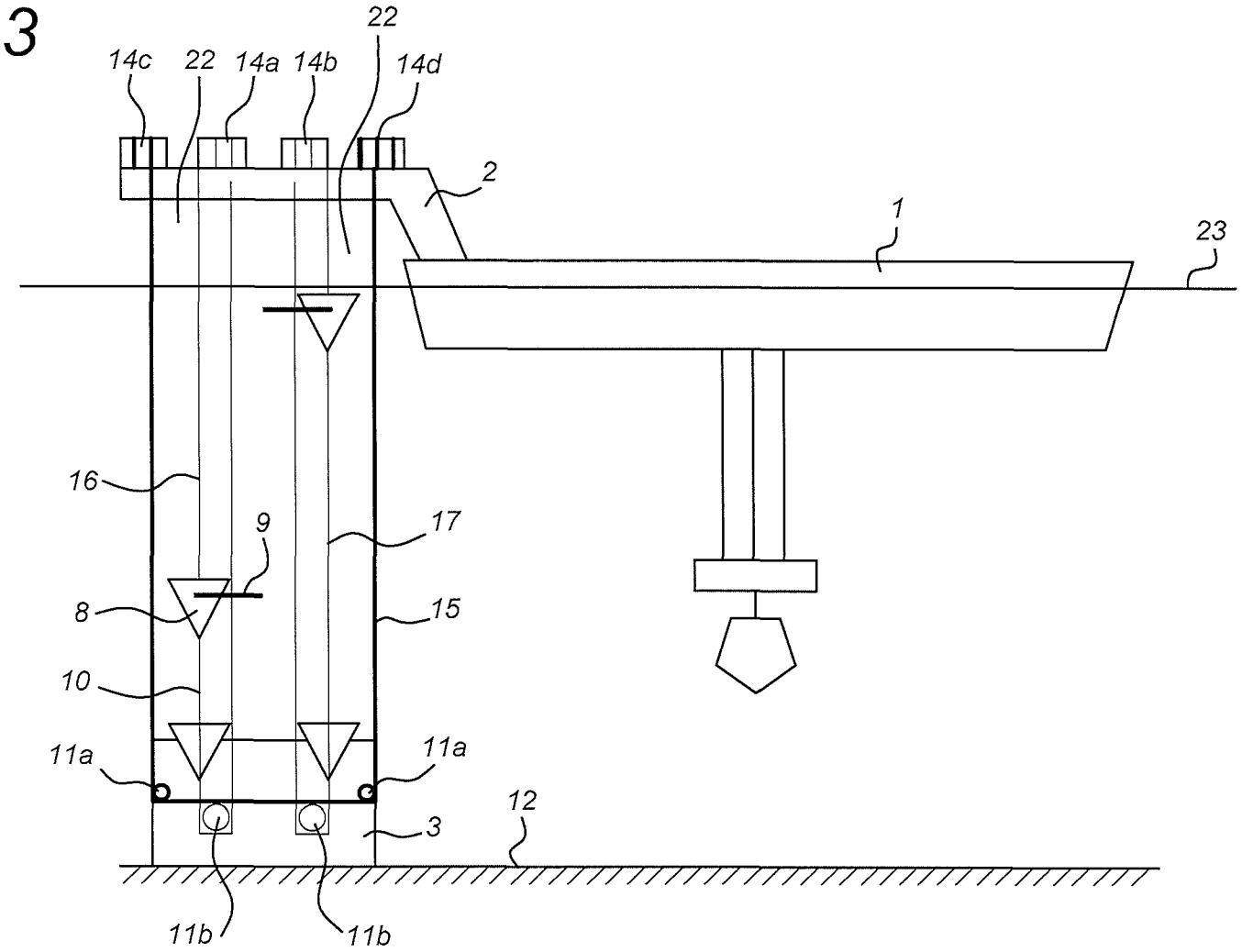
FIG. 3 a schematic side view of a third embodiment of a mining system according to the invention.

The embodiment of FIG. 3 differs with the first embodiment in that the lower platform 3 is provided with pulleys 11*b* in connection with the transportation of the containers 8, and pulleys 11*a* in connection with the lowering and lifting of the lower platform 3 via the cable 15. Respective transporting cables 16, 17 extend between respectively the winch

14*a* of the upper platform and a pulley 11*b*, and cable 17 between the winch 14*b* of the upper platform and another pulley 11*b*. The winches 14*c* and 14*d* serve for lowering and lifting the lower platform 3 via the cable 15 in conjunction with the pulleys 11*a* desired.

It will also be obvious after the above description and drawings are included to illustrate some embodiments of the invention, and not to limit the scope of protection. Starting from this disclosure, many more embodiments will be evident to a skilled person which are within the scope of protection and the essence of this invention and which are obvious combinations of prior art techniques and the disclosure of this patent.

The invention claimed is:

1. Mining system comprising;

a vessel for processing mined ore, an upper platform coupled with the vessel, a lower platform supported by an ocean floor, a plurality of transport cables which extend between the upper and lower platform, a container for containing ore, the container being fixedly coupled to one of the plurality of transporting cables such that the container moves vertically with the one of the transporting cables to transport the container in a container trajectory extending between the upper and lower platform, wherein a container transporting cable section of the one of the plurality of transporting cables extends below the container, and in use pulls the container downwards for preventing pivoting of the container with respect to the one of the plurality of transporting cables, wherein a coupling element directly couples the container with a neighbouring container guiding cable which is moving in an opposite direction than the one of the transporting cables and prevents pivoting of the container with respect to the one of the plurality of transporting cables during vertical transport of the container, and wherein the coupling element is configured such that the container is directly coupled with the neighbouring container guiding cable in a sliding or rolling manner to enable opposite movement.

2. Mining system according to claim 1, wherein the container is fixedly coupled with the one of the plurality of transporting cables extending in the entire container trajectory between the upper and lower platform.

3. Mining system according to claim 2, wherein the container is rotatably supported with respect to the one of the plurality of transporting cables for rotating the container around a container rotation axis between a transport position and an ore release position wherein the container is emptied.

4. Mining system according to claim 3, wherein the container rotation axis extends transverse with respect to the one of the plurality of transporting cables.

5. Mining system according to claim 2, wherein the one of the plurality of transporting cables extends centrally with respect to a portion of the container for containing ore.

6. Mining system according to claim 2, wherein the one of the plurality of transporting cables is tensioned in the entire container trajectory between the upper and lower platform during transport of the container.

7. Mining system according to claim 1, wherein the container guiding cable extends alongside the entire container trajectory.

8. Mining system according to claim 7, wherein the container guiding cable is tensioned alongside the entire container trajectory for preventing pivoting of the container.

9. Mining system according to claim 1, wherein the one of the plurality of transporting cables is coupled with the lower platform such that the one of the plurality of transporting cables turns and continues towards the upper platform.

10. Mining system according to claim 1, wherein the one of the plurality of transporting cables changes into the container guiding cable when turning at the lower platform.

11. Mining system according to claim 1, wherein, during transport of the container, the container guiding cable and the one of the plurality of transporting cables run in opposite direction.

12. Mining system according to claim 1, wherein the one of the plurality of transporting cables and the container guiding cable run substantially parallel to each other.

13. Mining system according to claim 1, wherein the coupling element is configured such that the coupling element moves with the container.

* * * * *